US011322174B2

(12) United States Patent
Jiang et al.

(10) Patent No.: US 11,322,174 B2
(45) Date of Patent: May 3, 2022

(54) VOICE DETECTION FROM SUB-BAND TIME-DOMAIN SIGNALS

(71) Applicant: SHENZHEN GOODIX TECHNOLOGY CO., LTD., Shenzhen (CN)

(72) Inventors: Bin Jiang, Shenzhen (CN); Jian Mao, Shenzhen (CN)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/034,096

(22) Filed: Sep. 28, 2020

(65) Prior Publication Data

US 2021/0012792 A1 Jan. 14, 2021

Related U.S. Application Data

(63) Continuation of application No. PCT/CN2019/092361, filed on Jun. 21, 2019.

(51) Int. Cl.

| | |
|---|---|
| ***G10L 25/78*** | (2013.01) |
| ***G10L 25/18*** | (2013.01) |
| ***G10L 25/84*** | (2013.01) |
| ***G10L 25/87*** | (2013.01) |
| ***G10L 21/0316*** | (2013.01) |
| ***G10L 25/45*** | (2013.01) |
| *G10L 25/93* | (2013.01) |

(52) U.S. Cl.

CPC ..... *G10L 25/87* (2013.01); *G10L 21/0316* (2013.01); *G10L 25/45* (2013.01); *G10L 2025/937* (2013.01)

(58) Field of Classification Search

CPC ..... G10L 19/02; G10L 21/02; G10L 21/0224; G10L 25/78; G10L 25/84; G10L 2025/783; G10L 25/18

USPC ..... 704/205, 210, 215, 226, 227, 228

See application file for complete search history.

(56) References Cited

U.S. PATENT DOCUMENTS 6,453,291 B1 * 9/2002 Ashley ..... G10L 25/78 704/200
6,718,301 B1 4/2004 Woods
9,524,735 B2 * 12/2016 Iyengar ..... G10L 25/84

(Continued)

FOREIGN PATENT DOCUMENTS

CN 103903634 A 7/2014
CN 106098076 A 11/2016

*Primary Examiner* — Martin Lerner

(74) *Attorney, Agent, or Firm* — Emerson, Thomson & Bennett, LLC; Roger D. Emerson; Warren A. Rosborough

(57) ABSTRACT

A method for detecting voice, an apparatus for detecting voice, and a chip for processing voice are disclosed. The apparatus includes: a sub-band generation module and a voice activity detection module; wherein the sub-band generation module is configured to process a current time-domain signal frame to obtain sub-band time-domain signals, and the voice activity detection module is configured to determine, according to amplitudes of the sub-band time-domain signals in the current time-domain signal frame, whether the current time-domain signal frame is an effective voice signal. The apparatus for detecting voice may be practiced in a time domain, such that complexity of algorithms is lowered, and power consumption is reduced.

15 Claims, 4 Drawing Sheets

(56) References Cited

U.S. PATENT DOCUMENTS

| | | | | |
|---|---|---|---|---|
| 2001/0014854 | A1* | 8/2001 | Stegmann | G10L 25/78 704/211 |
| 2009/0125305 | A1* | 5/2009 | Cho | G10L 25/78 704/233 |
| 2011/0264447 | A1* | 10/2011 | Visser | G10L 25/78 704/208 |
| 2012/0130711 | A1* | 5/2012 | Yamabe | G10L 25/78 704/231 |
| 2012/0265526 | A1 | 10/2012 | Yeldener et al. | |
| 2013/0073285 | A1* | 3/2013 | Hetherington | G10L 25/78 704/233 |
| 2016/0203833 | A1* | 7/2016 | Zhu | G10L 25/78 704/233 |
| 2017/0004840 | A1* | 1/2017 | Jiang | G10L 25/78 |
| 2017/0133041 | A1 | 5/2017 | Mortensen et al. | |
| 2017/0206908 | A1 | 7/2017 | Nesta et al. | |
| 2017/0206916 | A1* | 7/2017 | Zhu | G10L 25/78 |
| 2017/0263268 | A1* | 9/2017 | Rumberg | G10L 25/78 |

* cited by examiner

VOICE DETECTION FROM SUB-BAND TIME-DOMAIN SIGNALS

CROSS REFERENCE TO RELATED APPLICATIONS

The present application is a continuation of international application PCT/CN2019/092361, filed on Jun. 21, 2019, and entitled "METHOD FOR DETECTING VOICE, APPARATUS FOR DETECTING VOICE, AND CHIP FOR PROCESSING VOICE", the contents of which are hereby incorporated by reference in its entireties.

TECHNICAL FIELD

Embodiments of the present disclosure relate to the technical field of signal processing, and in particular, relate to a method for detecting voice, an apparatus for detecting voice, a chip for processing voice, and an electronic device.

BACKGROUND

Voice wakeup is widely applied, for example, in robots, mobile phones, wearable devices, smart homes, vehicle-mounted devices, and the like. In most devices equipped with a voice function, the voice wakeup technology needs to be mounted as a start and portal for man-to-machine interactions, which causes a dormant device to directly enter a standby state where the device is ready to operate to start voice interactions. Different products are configured with different wakeup words. When a user needs to wake up a device, the user only needs to speak aloud the corresponding wakeup word.

The voice wakeup words are practiced mainly depending on voice activity detection algorithms. However, in the related art, the voice activity detection algorithms are all based on frequency domain. As a result, the algorithms are complex, and power consumption is increased.

SUMMARY

In view of the above, embodiments of the present disclosure are intended to provide a method for detecting voice, an apparatus for detecting voice, a chip for processing voice, and an electronic device, to address the above technical defects in the related art.

Embodiments of the present application provide a method for detecting voice. The method includes:

processing a current time-domain signal frame to obtain sub-band time-domain signals; and determining, according to amplitudes of the sub-band time-domain signals in the current time-domain signal frame, whether the current time-domain signal frame is an effective voice signal.

Embodiments of the present disclosure further provide an apparatus for detecting voice. The apparatus includes: a sub-band generating module and a voice activity detecting module; wherein the sub-band generating module is configured to process a current time-domain signal frame to obtain sub-band time-domain signals, and the voice activity detecting module is configured to determine, according to amplitudes of the sub-band time-domain signals in the current time-domain signal frame, whether the current time-domain signal frame is an effective voice signal.

Embodiments of the present disclosure further provide a chip for processing voice. The chip includes: an apparatus for detecting voice and a processor. The apparatus includes:

a sub-band generation module and a voice activity detection module; wherein the sub-band generating module is configured to process a current time-domain signal frame to obtain sub-band time-domain signals, and the voice activity detection module is configured to determine, according to amplitudes of the sub-band time-domain signals in the current time-domain signal frame, whether the current time-domain signal frame is an effective voice signal. The processor is configured to identify the effective voice signal to perform voice control according to an identification result.

Embodiments of the present disclosure further provide an electronic device. The electronic device includes the chip for processing voice according to any embodiment of the present disclosure.

In the technical solutions according to embodiment of the present disclosure, a current time-domain signal frame is processed to obtain sub-band time-domain signals; and whether the current time-domain signal frame is an effective voice signal is determined according to amplitudes of the sub-band time-domain signals in the current time-domain signal frame. In this way, the solutions may be practiced in a time domain, such that complexity of algorithms is lowered, and power consumption is reduced.

BRIEF DESCRIPTION OF THE DRAWINGS

Some specific embodiments of the present disclosure are described in detail hereinafter in an exemplary fashion instead of a non-limiting fashion with reference to the accompanying drawings. In the drawings, like reference numerals denote like or similar parts or elements. A person skilled in the art should understand that these drawings may not be necessarily drawn to scale. Among the drawings.

DETAILED DESCRIPTION

Nevertheless, it is not necessary to require that any technical solution according to the embodiments of the present disclosure achieves all of the above technical effects.

Specific implementations of the embodiments of the present disclosure are further described hereinafter with reference to the accompanying drawings of the present disclosure.

In an embodiment of the present disclosure, a current time-domain signal frame is processed to obtain sub-band time-domain signals; and whether the current time-domain signal frame is an effective voice signal is determined according to amplitudes of the sub-band time-domain signals in the current time-domain signal frame. In this way, the solution may be practiced in a time domain, such that complexity of algorithms is lowered, and power consumption is reduced. In addition, a high voice detection accuracy is achieved.

Figure 1:
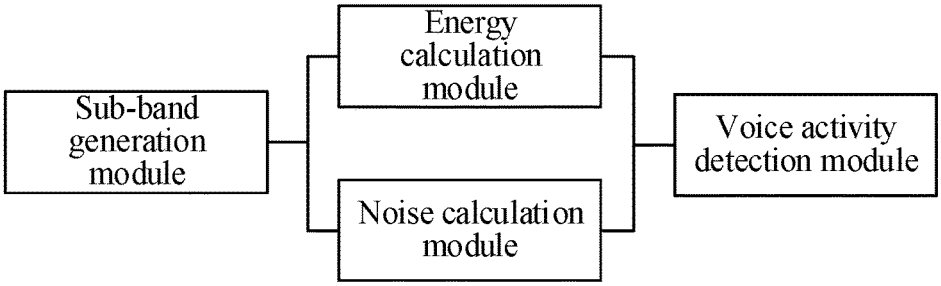
FIG. 1 is a schematic structural diagram of an apparatus for detecting voice according to a first embodiment of the present disclosure.

FIG. 1 is a schematic structural diagram of an apparatus for detecting voice according to a first embodiment of the present disclosure. As illustrated in FIG. 1, the apparatus includes: a sub-band generation module, an energy calculation module, a noise calculation module, a voice activity detection (VAD) module. The sub-band generation module is configured to process a current time-domain signal frame to obtain sub-band time-domain signals. The energy calculation module is configured to calculate signal amplitudes of the sub-band time-domain signals in the current time-domain signal frame according to amplitudes of the sub-band time-domain signals in the current time-domain signal frame. The noise calculation module is configured to calculate noise amplitudes of the sub-band time-domain signals according to the amplitudes of the sub-band time-domain signals in the current time-domain signal frame. The voice activity detection module is configured to determine, according to the amplitudes of the sub-band time-domain signals in the current time-domain signal frame, whether the current time-domain signal frame is an effective voice signal. Specifically, the voice activity detection module is configured to determine whether the current time-domain signal frame is an effective voice signal according to the noise amplitudes and the signal amplitudes of the sub-band time-domain signals.

In this embodiment, the current time-domain signal frame is from a voice acquisition module. For example, in a sampling cycle, the voice acquisition module acquires a voice signal, which may practically include time-domain signal frames. Therefore, whether the voice signals are from a user, that is, whether the voice signal is an effective voice signal, is determined in the unit of frame. That is, each of the time-domain signal frames is subjected to packet processing, energy calculation processing, noise calculation processing, and voice activity detection to determine whether a corresponding timing signal frame is an effective voice signal. In a specific application scenario, the voice acquisition module may be a microphone.

Specifically, the sub-band generation module is a filter bank. The filter bank processes the current time-domain signal frame according to a predefined frequency threshold to obtain sub-band time-domain signals. The filter bank may include a plurality of filters. Each of the filters has a predetermined frequency threshold. The plurality of filters respectively filter the current time-domain signal frame to obtain the sub-band time-domain signals. Each of the sub-band time-domain signals is assigned a corresponding sub-band identifier.

In this embodiment, a number of sub-filters in the filter bank is defined according to actual needs. That is, the number of sub-filters is defined according to a number of sub-bands into which the current time-domain signal frame is split. Herein, performance and complexity need to be balanced in defining the number of filters. For example, in consideration of power consumption and the like factors, two to three filters are configured. Nevertheless, herein, the number of filters is only an example, instead of causing any limitation.

Further, in a specific application scenario, the filter may be, for example, a finite impulse response (FIR) filter, or an infinite impulse response (IIR) filter. In case of further differentiation from the perspective of frequency response characteristics, the filter may be a bandpass filter. For example, the filter may be specifically a cascaded biquad IIR bandpass filter.

In this embodiment, the energy calculation module includes: an average amplitude calculation unit, configured to calculate average amplitudes of the sub-band time-domain signals in the current time-domain signal frame; and an energy calculation unit, configured to calculate the signal amplitudes of the sub-band time-domain signals in the current time-domain signal frame according to the average amplitudes of the sub-band time-domain signals in the current time-domain signal frame. The energy calculation unit is further configured to use the average amplitudes of the sub-band time-domain signals in the current time-domain signal frame to characterize the signal amplitudes of the sub-band time-domain signals. As described above, if the acquired voice signal may include voice signal frames, the current time-domain signal frame refers to a voice signal frame involved in voice signal detection. Further, since the filtering is performed for one voice signal frame, sub-band time-domain signals are obtained by filtering one voice signal frame. The energy calculation module calculates energy in the unit of sub-band time-domain signal. That is, the signal amplitude of each sub-band time-domain signal is calculated. It should be noted herein that the calculation herein may be considered as estimation.

Further, in some application scenarios, the corresponding signal amplitude of each sub-band time-domain signal is specifically represented by an estimated amplitude thereof. Specifically, the amplitude may be represented by a root mean square or an average value of absolute values of amplitudes of all sampling points in one sub-band time-domain signal.

Further, to prevent abrupt variations of the signal amplitudes in two consecutive time-domain signal frames, the energy calculation unit further calculates the signal amplitudes of the sub-band time-domain signals in the current time-domain signal frame according to an amplitude smooth value and the average amplitudes of the sub-band time-domain signals in the current time-domain signal frame.

Specifically, the energy calculation module is further configured to determine the amplitude smooth values according to an amplitude smooth coefficient and signal amplitudes in a previous time-domain signal frame. Herein, the magnitude of the amplitude smooth coefficient may be flexibly defined according to the application scenarios. The signal amplitudes in the previous time-domain signal frame are practically signal amplitudes obtained by performing the voice signal detection by taking the previous time-domain signal frame as the current time-domain signal frame.

From the perspective of signal processing, since the impacts caused by noise may be reflected on the signal amplitudes in the current time-domain signal frame, in this embodiment, the noise calculation module is further configured to calculate the noise amplitudes of the sub-band time-domain signals according to the signal amplitudes of the sub-band time-domain signals in the current time-domain signal frame. In calculation of the noise amplitudes of the sub-band time-domain signals according to the signal amplitudes of the sub-band time-domain signals in the current time-domain signal frame, since the sub-band time-domain signals herein correspond to the current time-domain signal frame, and the signal amplitudes in the previous time-domain signal frame are known, the signal amplitudes may be effectively used as a reference to determine the noise amplitudes in the current time-domain signal frame. In practice, the noise amplitudes in the current time-domain signal frame may be determined according to a relationship between the signal amplitudes of the sub-band time-domain signals in the current time-domain signal frame and the signal amplitudes of the sub-band time-domain signals in the previous time-domain signal frame having the same sub-band identifiers in the current time-domain signal frame. Accordingly, the following cases may be caused:

(1) when a signal amplitude of an $N^{th}$ sub-band time-domain signal in the current time-domain signal frame is greater than a noise amplitude of an $N^{th}$ sub-band time-domain signal in the previous time-domain signal frame, the noise calculation module is further configured to: calculate the noise amplitude of the $N^{th}$ sub-band time-domain signal according to a noise smooth value and the signal amplitude of the $N^{th}$ sub-band time-domain signal in the current time-domain signal frame, wherein the $N^{th}$ sub-band time-domain signal is any of the sub-band time-domain signals, and N is an integer greater than 0. Specifically, to prevent abrupt variations of the noise amplitudes in two consecutive time-domain signal frames, the noise calculation module is further configured to determine the noise smooth value according to the noise smooth coefficient and the noise amplitudes and the signal amplitudes in the previous time-domain signal frame.

(2) when the signal amplitude of an $N^{th}$ sub-band time-domain signal in the current time-domain signal frame is less than or equal to a noise amplitude of an $N^{th}$ sub-band time-domain signal in the previous time-domain signal frame, the noise calculation module is further configured to directly take the signal amplitude of the $N^{th}$ sub-band time-domain signal in the current time-domain signal frame as a noise amplitude of the $N^{th}$ sub-band time-domain signal, wherein the $N^{th}$ sub-band time-domain signal is any of the sub-band time-domain signals, and N is an integer greater than 0.

Figure 2:
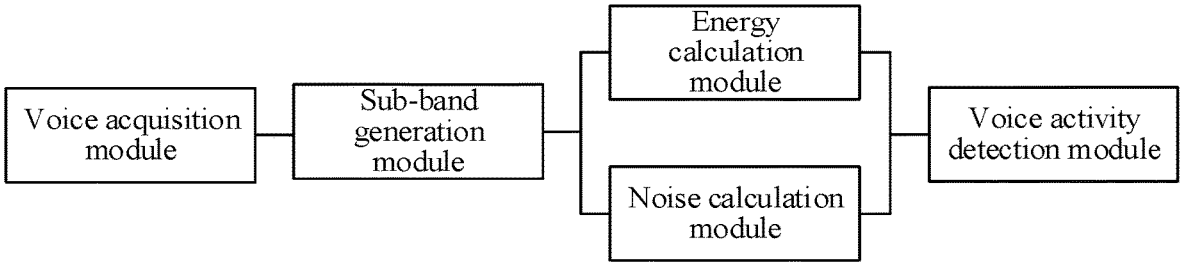
FIG. 2 is a schematic structural diagram of an apparatus for detecting voice according to a second embodiment of the present disclosure.

FIG. 2 is a schematic structural diagram of an apparatus for detecting voice according to a second embodiment of the present disclosure. As illustrated in FIG. 2, different from the above embodiment, in this embodiment, in addition to the sub-band generation module, the energy calculation module, the noise calculation module, and the voice activity detection module, the apparatus further includes a voice acquisition module. The voice acquisition module may be understood as a component of the apparatus for detecting voice. However, in the first embodiment, the voice acquisition module is independent of the apparatus for detecting voice, instead of a component of the apparatus for detecting voice.

In this embodiment, with respect to the current time-domain signal frame, by the first embodiment, the signal amplitudes of the sub-band time-domain signals included in the current time-domain signal frame are calculated, such that a total signal amplitude and a total noise amplitude in the current time-domain signal frame may be further calculated. Therefore, to reduce resource consumption and save power, the energy calculation module is further configured to calculate the total signal amplitude in the current time-domain signal frame according to the signal amplitudes of the sub-band time-domain signals in the current time-domain signal frame, the noise calculation module is further configured to calculate the total noise amplitude in the current time-domain signal frame according to the noise amplitudes of the sub-band time-domain signals in the current time-domain signal frame, and the voice activity detection module is further configured to determine, according to the total noise amplitude and the total signal amplitude, whether the current time-domain signal frame is an effective voice signal. It may be understood that, in this embodiment, whether the current time-domain signal frame is an effective voice signal is determined according to the total noise amplitude and the total signal amplitude in the current time-domain signal frame, such that technical complexity is effectively lowered, and resource consumption is reduced, or the requirements on the resources are lowered.

Further, in this embodiment, a plurality of noise energy levels is defined. A minimum noise energy level is referred to as a noise energy level lower limit, and a maximum noise energy level is referred to as a noise energy level upper limit. Therefore, in judgment on whether the current time-domain signal frame is an effective voice signal, the total noise amplitude and the total signal amplitude are respectively compared with the plurality of noise energy levels. If the total noise amplitude and the total signal amplitude are both less than the noise energy level lower limit, the voice activity detection module identifies that the current time-domain signal frame is a non-effective voice signal. If the total noise amplitude is greater than or equal to the noise energy level upper limit, whether the current time-domain signal frame is an effective voice signal is determined according to a default configuration item. The default configuration item herein may be flexibly defined according to the application scenarios. If the configuration item is that the current time-domain signal frame may be identified as an effective voice signal if the total noise amplitude is greater than or equal to the noise energy level upper limit, the voice activity detection module identifies that the current time-domain signal frame is an effective voice signal if the total noise amplitude is greater than or equal to the noise energy level upper limit. If the configuration item is that the current time-domain signal frame may be directly identified as a non-effective voice signal if the total noise amplitude is greater than or equal to the noise energy level upper limit, the voice activity detection module identifies that the current time-domain signal frame is a non-effective voice signal if the total noise amplitude is greater than or equal to the noise energy level upper limit.

Figure 3:
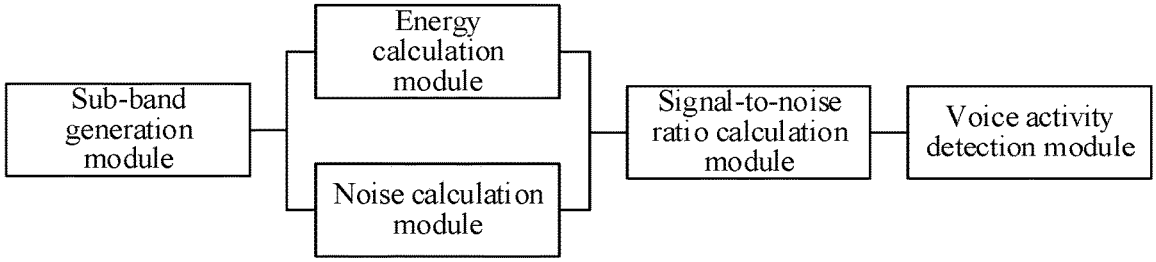
FIG. 3 is a schematic structural diagram of an apparatus for detecting voice according to a third embodiment of the present disclosure.

FIG. 3 is a schematic structural diagram of an apparatus for detecting voice according to a third embodiment of the present disclosure. As illustrated in FIG. 3, different from the above embodiment, in this embodiment, in addition to the sub-band generation module, the energy calculation module, the noise calculation module, and the voice activity detection module, the apparatus further includes: a signal-to-noise ratio calculation module, configured to calculate signal-to-noise ratios of the sub-band time-domain signals according to the noise amplitudes and the signal amplitudes of the sub-band time-domain signals in the current time-domain signal frame; and the voice activity detection module is further configured to determine, according to the total noise amplitude in the current time-domain signal frame and the signal-to-noise ratios of the sub-band time-domain signals in the current time-domain signal frame, whether the current time-domain signal frame is an effective voice signal.

In this embodiment, a plurality of signal-to-noise ratio levels is defined, and whether the current time-domain signal frame is an effective voice signal is determined according to the signal-to-noise ratios of the sub-band time-domain signals in the current time-domain signal frame and the signal-to-noise ratio levels.

Specifically, in some application scenarios, a plurality of signal-to-noise ratio levels may be correspondingly defined according to the plurality of noise energy levels of the sub-band time-domain signals.

Specifically, the following cases may be caused:

(1) The noise energy level lower limit corresponds to a signal-to-noise ratio level upper limit; if the total noise amplitude in the current time-domain signal frame is less than or equal to the noise energy level lower limit, whether the signal-to-noise ratios of the sub-band time-domain signals in the current time-domain signal frame are greater than or equal to the signal-to-noise ratio level upper limit is determined; and the voice activity detection module identifies that the current time-domain signal frame is an effective voice signal when the signal-to-noise ratios of the sub-band time-domain signals in the current time-domain signal frame are greater than or equal to the signal-to-noise ratio level upper limit, and identifies that the current time-domain signal frame is a non-effective voice signal when the signal-to-noise ratios of the sub-band time-domain signals in the current time-domain signal frame are less than the signal-to-noise ratio level upper limit.

(2) The noise energy level upper limit corresponds to a signal-to-noise ratio level lower limit; if the total noise amplitude in the current time-domain signal frame is greater than or equal to the noise energy level upper limit, whether the signal-to-noise ratios of the sub-band time-domain signals in the current time-domain signal frame are greater than or equal to the signal-to-noise ratio level lower limit is determined; and the voice activity detection module identifies that the current time-domain signal frame is an effective voice signal when the signal-to-noise ratios of the sub-band time-domain signals in the current time-domain signal frame are greater than or equal to the signal-to-noise ratio level lower limit, and identifies that the current time-domain signal frame is a non-effective voice signal when the signal-to-noise ratios of the sub-band time-domain signals in the current time-domain signal frame are less than the signal-to-noise ratio level lower limit.

(3) A signal-to-noise ratio level intermediate threshold between the signal-to-noise ratio level upper limit and the signal-to-noise ratio level lower limit is defined between the noise energy level upper limit and the noise energy level lower limit; if the total noise amplitude in the current time-domain signal frame is greater than or equal to the noise energy level intermediate threshold, whether the signal-to-noise ratios of the sub-band time-domain signals in the current time-domain signal frame are greater than or equal to the corresponding signal-to-noise ratio level intermediate threshold is determined; and the voice activity detection module is configured to determine that the current time-domain signal frame is an effective voice signal when the signal-to-noise ratios of the sub-band time-domain signals in the current time-domain signal frame are greater than or equal to the signal-to-noise ratio level intermediate threshold, and determine that the current time-domain signal frame is a non-effective voice signal when the signal-to-noise ratios of the sub-band time-domain signals in the current time-domain signal frame are less than the signal-to-noise ratio level intermediate threshold.

It should be noted that in the above embodiment, description is given only using the scenario where the apparatus for detecting voice includes the energy calculation module and the noise calculation module as an example. However, the energy calculation module and the noise calculation are not necessarily indispensable modules for practicing the present disclosure.

Figure 4:
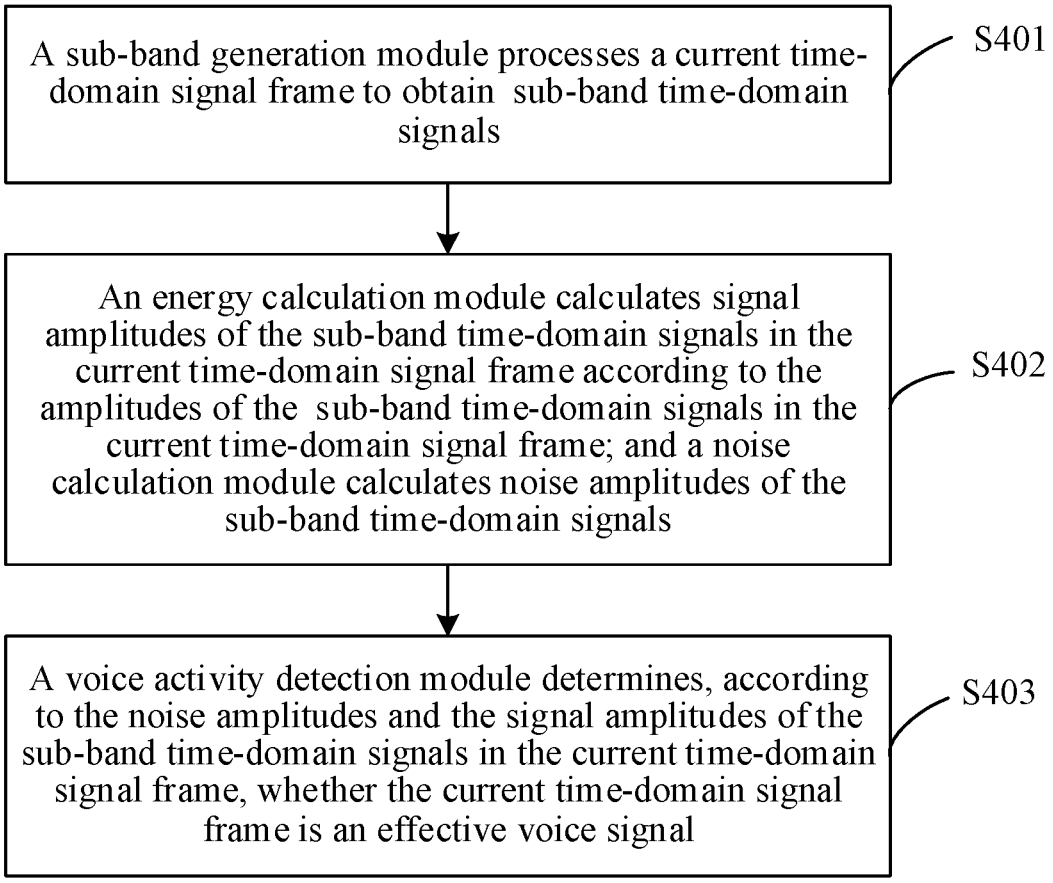
FIG. 4 is a schematic flowchart of a method for detecting voice according to a fourth embodiment of the present disclosure.

FIG. 4 is a schematic flowchart of a method for detecting voice according to a fourth embodiment of the present disclosure. As illustrated in FIG. 4, the method includes the following steps:

In S401, a sub-band generation module processes a current time-domain signal frame to obtain sub-band time-domain signals.

In this embodiment, referring to the example as illustrated in FIG. 1, a filter bank is taken as the sub-band generation module to filter the current time-domain signal frame to obtain the sub-band time-domain signals.

In this embodiment, the current time-domain signal frame is from a voice acquisition module. For example, in a sampling cycle, the voice acquisition module obtains current voice signals by sampling at a current sampling time i and analog-to-digital conversion. Each N current voice signals x(i) form a time-domain signal frame, wherein an $n^{th}$ time-domain signal frame is marked as x(n), and taken as the current time-domain signal frame. Further, if totally M sub-band time-domain signals are obtained by filtering the $n^{th}$ time-domain signal frame x(n), an $m^{th}$ sub-band time-domain signal therein is marked as $x_m(n)$, wherein m is in the range of 1 to m.

In S402, an energy calculation module calculates signal amplitudes of the sub-band time-domain signals in the current time-domain signal frame according to the amplitudes of the sub-band time-domain signals in the current time-domain signal frame; and a noise calculation module calculates noise amplitudes of the sub-band time-domain signals.

Specifically, referring to the above embodiment, the signal amplitudes of the sub-band time-domain signals in the current time-domain signal frame are calculated according to average amplitudes of the sub-band time-domain signals in the current time-domain signal frame. In practice, when the signal amplitudes of the sub-band time-domain signals in the current time-domain signal frame are calculated according to the amplitude smooth values and the average amplitudes of the sub-band time-domain signals in the current time-domain signal frame, reference may be made to formula (1).

Specifically, in this embodiment, an average amplitude calculation unit calculates an average amplitude of each of the sub-band time-domain signals in the current time-domain signal frame according to formula (1).

$$E_m(n) = \frac{1}{N}\sum_{i=1}^{N}|x_{m,i}(n)|, \quad i = 1, \ldots, N \tag{1}$$

In formula (1), $x_{m,i}(n)$ represents an $m^{th}$ sub-band time-domain signal in an $n^{th}$ time-domain signal frame, $E_m(n)$ represents an average amplitude of the $m^{th}$ sub-band time-domain signal in the $n^{th}$ time-domain signal frame, the $n^{th}$ time-domain signal frame is the current time-domain signal frame, i represents a sampling point, and N represents the number of sampling points.

Further, the energy calculation unit calculates the signal amplitudes of the sub-band time-domain signals in the current time-domain signal frame according to formula (2), wherein the signal amplitudes are intended to characterize the corresponding signal amplitudes of the sub-band time-domain signals.

$$S_m(n)=\alpha_1 * S_m(n-1)+(1-\alpha_1)*E_m(n) \tag{2}$$

$S_m(n)$ represents a signal amplitude of the $m^{th}$ sub-band time-domain signal in the $n^{th}$ time-domain signal frame, $S_m(n-1)$ represents a signal amplitude of an $m^{th}$ sub-band time-domain signal in an $(n-1)^{th}$ time-domain signal frame, $E_m(n)$ represents the average amplitude of the $m^{th}$ sub-band time-domain signal in the $n^{th}$ time-domain signal frame, $\alpha_1$ represents a strength smooth coefficient, $0<\alpha_1<1$. Herein, it should be noted that the signal amplitude $S_m(n-1)$ of the $m^{th}$ sub-band time-domain signal in the $(n-1)^{th}$ time-domain signal frame may be an amplitude subjected to smoothing, wherein n is greater than or equal to 1.

Specially, when n=1, since the $(n-1)^{th}$ frame does not exist, an initial amplitude may be defined in the above formula according to the application scenario, to represent $S_m(n-1)$. Nevertheless, considering that the smoothing mainly prevents abrupt variations of the amplitudes of the sub-band time-domain signals between two signal frames, when n=1, since the $(n-1)^{th}$ frame does not exist, the initial amplitude may be directly 0.

As seen from formula (2), the amplitude smooth value $\alpha_1 * S_m(n-1)$ is determined according to an amplitude smooth coefficient $\alpha_1$ and signal amplitudes $S_m(n-1)$ in a previous time-domain signal frame.

In step S402, in calculation of the noise amplitudes of the sub-band time-domain signals, the noise calculation module calculates the noise amplitudes in the current time-domain signal frame according to a relationship between the signal amplitudes of the sub-band time-domain signals in the current time-domain signal frame and the signal amplitudes of the sub-band time-domain signals in the previous time-domain signal frame having the same sub-band identifiers in the current time-domain signal frame. Accordingly, the following cases may be caused:

(1) when the signal amplitude of an $N^{th}$ sub-band time-domain signal in the current time-domain signal frame is greater than a noise amplitude of an $N^{th}$ sub-band time-domain signal in the previous time-domain signal frame, the noise calculation module is further configured to: calculate the noise amplitude of the $N^{th}$ sub-band time-domain signal according to a noise smooth value and the signal amplitude of the $N^{th}$ sub-band time-domain signal in the current time-domain signal frame, wherein the $N^{th}$ sub-band time-domain signal is any of the sub-band time-domain signals, and N is an integer greater than 0. Specifically, to prevent abrupt variations of the noise amplitudes in two consecutive time-domain signal frames, the noise calculation unit is further configured to determine the noise smooth value according to the noise smooth coefficient and the noise amplitudes in and the signal amplitudes in the previous time-domain signal frame.

In this case, considering continuity of noise tracking, before it is determined that the current time-domain signal frame is an effective voice signal, the noise amplitude of the $m^{th}$ sub-band time-domain signal in the $n^{th}$ time-domain signal frame is calculated according to formula (3), such that continuity of noise tracking is ensured.

$$N_m(n) = \gamma * N_m(n-1) + \frac{1-\gamma}{1-\beta} * [S_m(n) - \beta * S_m(n-1)] \tag{3}$$

In formula (3), $N_m(n)$ represents a noise amplitude of the $m^{th}$ sub-band time-domain signal in the $n^{th}$ time-domain signal frame and is intended to characterize a corresponding noise amplitude, $N_m(n-1)$ represents a noise amplitude of the $m^{th}$ sub-band time-domain signal in the $(n-1)^{th}$ time-domain signal frame, $S_m(n)$ represents a signal amplitude of the $m^{th}$ sub-band time-domain signal in the $n^{th}$ time-domain signal frame, $S_m(n-1)$ represents a signal amplitude of the $m^{th}$ sub-band time-domain signal in the $(n-1)^{th}$ time-domain signal frame, $\gamma$ and $\beta$ represent noise smooth coefficient, wherein $0<\gamma<1$, $0<\beta<1$, and n is greater than or equal to 1.

Specially, when n=1, since the $(n-1)^{th}$ frame does not exist, an initial amplitude may be defined for each of $N_m(n-1)$ and $S_m(n-1)$ in the above formula according to the application scenario, to represent $N_m(n-1)$. Nevertheless, considering that the smoothing mainly prevents abrupt variations of the amplitudes of the sub-band time-domain signals between two signal frames, when n=1, since the $(n-1)^{th}$ frame does not exist, the initial amplitudes of $N_m(n-1)$ and $S_m(n-1)$ may be directly 0. When n is greater than 1, $N_m(n-1)$ and $S_m(n-1)$ respectively represent corresponding amplitudes subject to smoothing.

In this embodiment, in calculation of the noise of the sub-band time-domain signals, the noise smooth value is determined according to a noise smooth coefficient and the noise amplitudes and the signal amplitudes in the previous time-domain signal frame. As seen from formula (3), $\gamma * N_m(n-1)$ represents one noise smooth value, $$\frac{1-\gamma}{1-\beta} * [\beta * S_m(n-1)]$$

represents another noise smooth value. Alternatively, in summary, a first noise smooth coefficient and a second noise smooth coefficient are defined, a first noise smooth value is determined according to the first noise smooth coefficient and the noise amplitudes in the previous time-domain signal frame, and a second noise smooth value is determined according to the first noise smooth coefficient and the second noise smooth coefficient and the signal amplitudes in the previous time-domain signal frame. In this way, noise abrupt variation of the $m^{th}$ sub-band time-domain signal in the $n^{th}$ time-domain signal frame are prevented in the current voice signal x(i).

(2) When the signal amplitude of an $N^{th}$ sub-band time-domain signal in the current time-domain signal frame is less than or equal to a noise amplitude of an $N^{th}$ sub-band time-domain signal in the previous time-domain signal frame, the noise calculation module is further configured to directly take the signal amplitude of the $N^{th}$ sub-band time-domain signal in the current time-domain signal frame as the noise amplitude of the $N^{th}$ sub-band time-domain signal, wherein the $N^{th}$ sub-band time-domain signal is any of the sub-band time-domain signals, and N is an integer greater than 0.

In this case, the noise amplitude of the $m^{th}$ sub-band time-domain signal in the $n^{th}$ time-domain signal frame is calculated according to formula (4).

$$N_m(n)=S_m(n) \tag{4}$$

In formula (4), $N_m(n)$ represents a noise amplitude of the $m^{th}$ sub-band time-domain signal in the $n^{th}$ time-domain signal frame, $S_m(n)$ represents a signal amplitude of the $m^{th}$ sub-band time-domain signal in the $n^{th}$ time-domain signal frame, which may be an amplitude subjected to smoothing.

With reference to formula (3), in step S402, the noise amplitudes of the sub-band time-domain signals are calculated according to the signal amplitudes of the sub-band time-domain signals in the current time-domain signal frame. Further, when the signal amplitudes of the sub-band time-domain signals in the current time-domain signal frame are greater than the noise amplitudes of the sub-band time-domain signals in the previous time-domain signal frame having the same sub-band identifiers in the current time-domain signal frame, the noise amplitudes of the sub-band time-domain signals in the current time-domain signal frame are calculated according to the signal amplitudes of the sub-band time-domain signals in the current time-domain signal frame and the noise smooth value.

With reference to formula (4), in step S402, in calculation of the signal amplitudes of the sub-band time-domain signals in the current time-domain signal frame, first, the average amplitudes of the sub-band time-domain signals in the current time-domain signal frame is calculated, and then the signal amplitudes of the sub-band time-domain signals in the current time-domain signal frame is calculated according to the average amplitudes of the sub-band time-domain signals in the current time-domain signal frame. In calculation of the noise amplitudes of the sub-band time-domain signals, the signal amplitudes of the sub-band time-domain signals in the current time-domain signal frame are less than or equal to the noise amplitudes of the sub-band time-domain signals in the previous time-domain signal frame having the same sub-band identifiers in the current time-domain signal frame, the signal amplitudes of the sub-band time-domain signals in the current time-domain signal frame are directly taken as the noise amplitudes of the sub-band time-domain signals in the current time-domain signal frame.

Herein, it should be noted that the cases illustrated by formula (3) or formula (4) may not be necessarily practiced in the same embodiment. In practice, according to actual application scenarios, the signal amplitudes may be calculated according to only formula (3) or only formula (4).

In S403, a voice activity detection module determines, according to the noise amplitudes and the signal amplitudes of the sub-band time-domain signals in the current time-domain signal frame, whether the current time-domain signal frame is an effective voice signal.

In step S403, a plurality of noise energy levels and energy levels are defined for the sub-band time-domain signals, and the voice activity detection module may specifically compare the noise amplitudes and the signal amplitudes of the sub-band time-domain signals with the noise energy levels and the energy levels, to determine whether the $n^{th}$ time-domain signal frame in the current voice signal x(i) is an effective voice signal.

Figure 5:
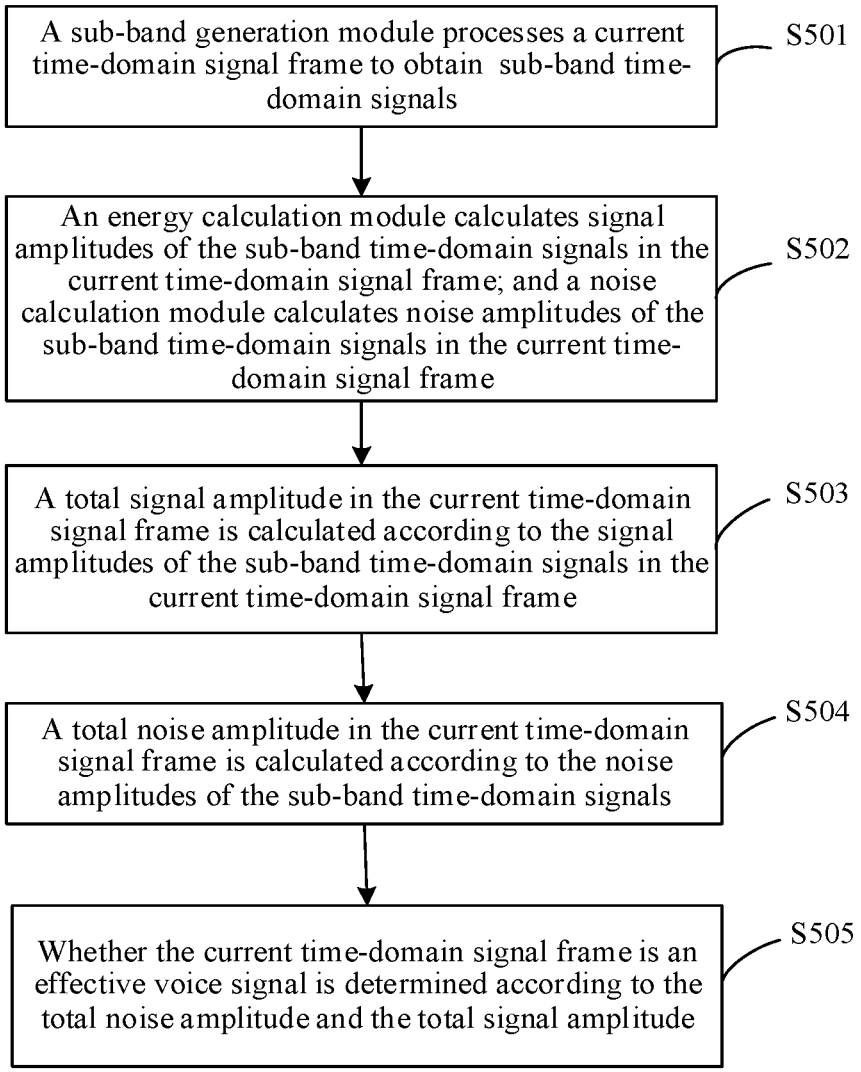
FIG. 5 is a schematic flowchart of a method for detecting voice according to a fifth embodiment of the present disclosure.

FIG. 5 is a schematic flowchart of a method for detecting voice according to a fifth embodiment of the present disclosure. As illustrated in FIG. 5, the method includes the following steps:

In S501, a sub-band generation module processes a current time-domain signal frame to obtain sub-band time-domain signals.

In S502, an energy calculation module calculates signal amplitudes of the sub-band time-domain signals in the current time-domain signal frame; and a noise calculation module calculates noise amplitudes of the sub-band time-domain signals in the current time-domain signal frame.

In this embodiment, step S501 and step S502 are respectively similar to step S401 and step S402 in the embodiment as illustrated in FIG. 4.

In S503, a total signal amplitude in the current time-domain signal frame is calculated according to the signal amplitudes of the sub-band time-domain signals in the current time-domain signal frame.

$$S_t(n)=\Sigma_{m=1}^{M}S_m(n) \tag{5}$$

$S_t(n)$ represents a total signal amplitude in the $n^{th}$ time-domain signal frame.

As seen from formula (5), $S_t(n)$ actually represents a sum of the signal amplitudes of M sub-band time-domain signals in an $n^{th}$ time-domain signal frame.

In S504, a total noise amplitude in the current time-domain signal frame is calculated according to the noise amplitudes of the sub-band time-domain signals.

$$N_t(n)=\Sigma_{m=1}^{M}N_m(n) \tag{6}$$

$N_t(n)$ represents a total signal amplitude in the $n^{th}$ time-domain signal frame and is intended to characterize a total noise amplitude.

As seen from formula (6), $N_t(n)$ actually represents a sum of the noise amplitudes of the M sub-band time-domain signals in the $n^{th}$ time-domain signal frame.

In S505, whether the current time-domain signal frame is an effective voice signal is determined according to the total noise amplitude and the total signal amplitude.

In this embodiment, in judgment on whether the current time-domain signal is an effective voice signal in step S505, as described above, since a plurality of noise energy levels are defined, if the total noise amplitude and the total signal amplitude are both less than a noise energy level lower limit, the current time-domain signal frame is identified as a non-effective voice signal.

For example, in an application scenario, noise energy levels thn(k), k=1, . . . , K are defined, wherein thn(1) represents a noise energy level lower limit or a lowest noise energy level, thn(K) represents a noise energy level upper limit or a highest noise energy level, and with the increase of k, the level thn(k) progressively becomes greater, which indicates that the noise strength becomes greater. The number K of noise energy levels may be defined according to the requirement on judgment accuracy.

If $N_t(n)<thn(1)$ && $S_t(n)<thn(1)$, the total signal amplitude and the total noise amplitude in the $n^{th}$ time-domain signal frame in the current voice signal x(i) are both less than the noise energy level lower limit. In this case, the noise strength is extremely low, and no voice is generated. Therefore, the $n^{th}$ time-domain signal frame is identified as a non-effective voice signal.

With respect to the voice activity detection module, if an output signal VAD(n)=0 is generated, the $n^{th}$ time-domain signal frame is a non-effective voice signal.

For example, in another application scenario, if the total noise amplitude is greater than or equal to the noise energy level upper limit, it is difficult to determine whether the current time-domain signal frame is an effective voice signal. Therefore, whether the current time-domain signal frame is an effective voice signal is determined according to a default configuration item.

If $N_t(n)>thn(K)$, that is, the total noise amplitude in the $n^{th}$ time-domain signal frame is greater than the noise energy level upper limit, the noise strength is higher, and it is difficult to make a judgment. If a default configuration item $D_{highnoise}$ is defined, correspondingly, the voice activity detection module generates an output signal VAD(n)=$D_{highnoise}$. If $D_{highnoise}$=0, the $n^{th}$ time-domain signal frame may be identified as a non-effective voice signal. If $D_{highnoise}$=1, the $n^{th}$ time-domain signal frame may be identified as an effective voice signal.

Figure 6:
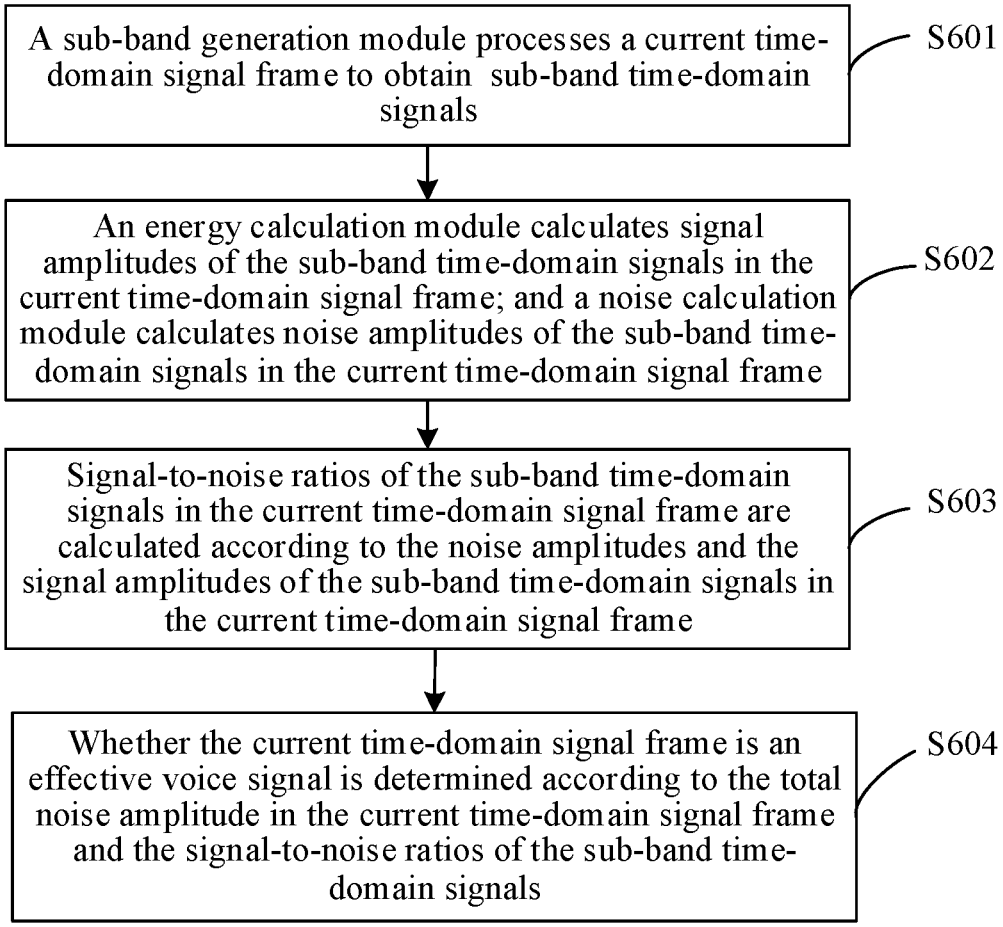
FIG. 6 is a schematic flowchart of a method for detecting voice according to a sixth embodiment of the present disclosure.

FIG. 6 is a schematic flowchart of a method for detecting voice according to a sixth embodiment of the present disclosure. As illustrated in FIG. 6, the method includes the following steps:

In S601, a sub-band generation module processes a current time-domain signal frame to obtain sub-band time-domain signals.

In S602, an energy calculation module calculates signal amplitudes of the sub-band time-domain signals in the current time-domain signal frame; and a noise calculation module calculates noise amplitudes of the sub-band time-domain signals in the current time-domain signal frame.

In S603, signal-to-noise ratios of the sub-band time-domain signals in the current time-domain signal frame are calculated according to the noise amplitudes and the signal amplitudes of the sub-band time-domain signals in the current time-domain signal frame.

In this embodiment, the signal-to-noise ratios are calculated according to formula (7).

$$SNR_m(n)=S_m(n)/N_m(n) \quad (7)$$

In formula (7), $SNR_m(n)$ represents a signal-to-noise ratio in the $n^{th}$ time-domain signal frame.

In S604, whether the current time-domain signal frame is an effective voice signal is determined according to the total noise amplitude in the current time-domain signal frame and the signal-to-noise ratios of the sub-band time-domain signals.

In this embodiment, step S604 may specifically include: determining, according to the signal-to-noise ratios of the sub-band time-domain signals in the current time-domain signal frame and signal-to-noise ratio levels, whether the current time-domain signal frame is an effective voice signal.

In this embodiment, with reference to formula (7), with respect to the $n^{th}$ time-domain signal frame, the signal-to-noise ratios therein are closely related to the total noise amplitude. A plurality of noise energy levels are defined with respect to the noise amplitudes. Correspondingly, a plurality of signal-to-noise ratio levels may also be defined. The noise energy levels are mapped to the signal-to-noise ratio levels. In this way, whether the $n^{th}$ time-domain signal frame is an effective voice signal is determined.

Exemplarily, in a specific application scenario, signal-to-noise ratio levels $SNR_m$ grade thsnr(k), k=1, . . . , K corresponding to noise energy levels thn(k) are defined, K represents the number of levels. In this embodiment, the noise energy levels correspond to the signal-to-noise ratio levels. For example, the noise energy levels thn(1) to thn(K) are ranked from a minimum value to a maximum value, wherein thn(1) represents a noise energy level lower limit, and thn(K) represents a noise energy level upper limit. In this case, the signal-to-noise ratio levels thsnr(1) to thsnr(K) are ranked from a maximum value to a minimum value, wherein thsnr(1) represents a signal-to-noise ratio level upper limit, and thsnr(K) represents a signal-to-noise ratio level lower limit. A lower noise energy level corresponds to a higher signal-to-noise ratio level, and a higher noise energy level corresponds to a lower signal-to-noise ratio level. Alternatively, the number of noise energy levels is equal to the number of signal-to-noise ratio levels. The higher the noise energy level, the higher the signal-to-noise ratio level, and the smaller the value of the signal-to-noise ratio level. However, the value of the signal-to-noise ratio level may be flexibly defined according to actual application scenarios, such that misjudgment of the effective voice signal is prevented. Specifically, the following cases may be caused:

(1) When the total noise amplitude in the current time-domain signal frame is less than or equal to the noise energy level lower limit, whether the signal-to-noise ratios of the sub-band time-domain signals in the current time-domain signal frame are greater than or equal to the signal-to-noise ratio level upper limit is determined; and the current time-domain signal frame is identified as an effective voice signal when the signal-to-noise ratios of the sub-band time-domain signals in the current time-domain signal frame are greater than or equal to the signal-to-noise ratio level upper limit, and the current time-domain signal frame is identified as a non-effective voice signal when the signal-to-noise ratios of the sub-band time-domain signals in the current time-domain signal frame are less than the signal-to-noise ratio level upper limit.

In practice, for example, if $N_t(n)<thn(1)$, whether the signal-to-noise ratios of the sub-band time-domain signals in the current time-domain signal frame are greater than or equal to the signal-to-noise ratio level upper limit is determined; and the current time-domain signal frame is identified as an effective voice signal when the signal-to-noise ratio $SNR_m(n)$ in the $n^{th}$ time-domain signal frame is greater than or equal to thsnr(1), and the current time-domain signal frame is identified as a non-effective voice signal when the signal-to-noise ratio $SNR_m(n)$ in the $n^{th}$ time-domain signal frame is less than thsnr(1).

(2) If the total noise amplitude in the current time-domain signal frame is greater than or equal to the noise energy level upper limit, whether the signal-to-noise ratios of the sub-band time-domain signals in the current time-domain signal frame are greater than or equal to the signal-to-noise ratio level lower limit is determined; and the current time-domain signal frame is identified as an effective voice signal when the signal-to-noise ratios of the sub-band time-domain signals in the current time-domain signal frame are greater than or equal to the signal-to-noise ratio level lower limit, and the current time-domain signal frame is identified as a non-effective voice signal when the signal-to-noise ratios of the sub-band time-domain signals in the current time-domain signal frame are less than the signal-to-noise ratio level lower limit.

In practice, for example, when $N_t(n)>thn(K)$, whether the signal-to-noise ratios of the sub-band time-domain signals in the current time-domain signal frame are greater than or equal to the signal-to-noise ratio level lower limit is determined; and the current time-domain signal frame is identified as an effective voice signal when the signal-to-noise ratio $SNR_m(n)$ in the $n^{th}$ time-domain signal frame is greater than or equal to thsnr(K), and the current time-domain signal frame is identified as a non-effective voice signal when the signal-to-noise ratio $SNR_m(n)$ in the $n^{th}$ time-domain signal frame is less than thsnr(K).

(3) If the total noise amplitude in the current time-domain signal frame is greater than or equal to a noise energy level intermediate threshold, whether the signal-to-noise ratios of the sub-band time-domain signals in the current time-domain signal frame are greater than or equal to a corresponding signal-to-noise ratio level intermediate threshold is determined; and the current time-domain signal frame is identified an effective voice signal when the signal-to-noise ratios of the sub-band time-domain signals in the current time-domain signal frame are greater than or equal to the signal-to-noise ratio level intermediate threshold, and the current time-domain signal frame is identified as a non-effective voice signal when the signal-to-noise ratios of the sub-band time-domain signals in the current time-domain signal frame are less than the signal-to-noise ratio level intermediate threshold.

In practice, the noise energy level intermediate threshold is thn(q), wherein $1<q<K$, and thn(q) may be any one noise energy level of thn(1) and thn(1). When $thn(q-1)<N_t(n)<thn(q)$, $1<q<K$, whether the signal-to-noise ratios of the sub-band time-domain signals in the current time-domain signal frame are greater than or equal to a corresponding signal-to-noise ratio level intermediate threshold thsnr(q−1), and the signal-to-noise ratio level intermediate threshold thsnr (q−1) corresponds to a noise energy level thn(q−1). When the signal-to-noise ratio $SNR_m(n)$ in the $n^{th}$ time-domain signal frame is greater than or equal to thsnr(q−1), the current time-domain signal frame is identified as an effective voice signal; and when the signal-to-noise ratio $SNR_m(n)$ in the $n^{th}$ time-domain signal frame is less than thsnr(q−1), the current time-domain signal frame is identified as a non-effective voice signal. In this embodiment, the noise energy level intermediate threshold may be considered as any threshold in the noise energy levels. In addition, in this embodiment, if $thn(q-1)<N_t(n)\leq thn(q)$, $1<q<K$, whether the signal-to-noise ratios of the sub-band time-domain signals in the current time-domain signal frame are greater than or equal to a corresponding signal-to-noise ratio level intermediate threshold thsnr(q), and the signal-to-noise ratio level intermediate threshold thsnr(q) corresponds to a noise energy level thn(q). Where the noise is smaller, a higher signal-to-noise ratio level is selected to compare with the signal-to-noise ratios; and where the noise is greater, a lower signal-to-noise ratio level is selected to compare with the signal-to-noise ratios. In this way, whether the current time-domain signal frame is an effective voice signal may be more accurately determined.

As known from the above process, practically, first the noise energy level corresponding to $N_t(n)$ is determined, then the signal-to-noise ratio level thsnr(q) corresponding to the noise energy level is determined according to a result of comparison with the noise energy level, and the signal-to-noise ratio $SNR_m(n)$ corresponding to $N_t(n)$ is compared with the signal-to-noise ratio level thsnr(q). When the signal-to-noise ratio $SNR_m(n)$ of any sub-band time-domain signals in the $n^{th}$ time-domain signal frame is greater than the corresponding signal-to-noise ratio level thsnr(q), the $n^{th}$ time-domain signal frame is identified as an effective voice signal.

On the basis of the above embodiment, if VAD(n−1)=0 and VAD(n)=1, an effective voice signal starts to be detected. In this case, the acquired voice signal may be transmitted. For more complete transmission of the voice signal to a next stage, a part of history voice signals may be buffered. Upon detection of start of voice, the history voice signals may be acquired from a buffer region and then transmitted, such that voice detection is advanced, and voice signal having smaller amplitudes upon start of voice may not be missed. The size of the buffer region may be flexibly configured according to application scenarios. That is, detected effective voice is buffered after it is identified that an effective voice signal is detected.

A chip for processing voice according to an embodiment of the present disclosure is provided. The chip includes: an apparatus for detecting voice and a processor. The apparatus includes: a sub-band generation module, an energy calculation module, a noise calculation module, a voice activity detection module. The sub-band generation module is configured to process a current time-domain signal frame to obtain sub-band time-domain signals. The energy calculation module is configured to calculate signal amplitudes of the sub-band time-domain signals in the current time-domain signal frame. The noise calculation module is configured to calculate noise amplitudes of the sub-band time-domain signals. The voice activity detection module is configured to determine, according to the amplitudes of the sub-band time-domain signals in the current time-domain signal frame, whether the current time-domain signal frame is an effective voice signal. Specifically, the voice activity detection module is configured to determine whether the current time-domain signal frame is an effective voice signal according to the noise amplitudes and the signal amplitudes of the sub-band time-domain signals. The processor is configured to identify the effective voice signal to perform voice control according to an identification result. In this embodiment, for other exemplary interpretations of the apparatus for detecting voice, reference may be made to the above embodiment.

It should be noted herein that with respect to the cases where a plurality of voice detection methods, conditions thereof, or derivatives thereof are available in the above embodiment, these methods, conditions, or derivatives are not necessarily practiced in the same embodiment simultaneously. In practice, the technical solution may be configured to be directed to one of the above cases according to the requirement of the application scenario. For example, with respect to the judgment on whether the current time-domain signal frame is an effective voice signal according to the total signal amplitude and the total noise amplitude, if the judgment may be carried out according to the total signal amplitude and the total noise amplitude, the judgment is directly made; and if the judgment may not be carried out according to the total signal amplitude and the total noise amplitude, the process directly skips to process a next time-domain signal frame; or the signal frame is simply processed according to the default configuration item, to reduce power consumption and lower technical complexity.

For detailed descriptions of various structural units in the apparatus for detecting voice, reference may be made to disclosure of the embodiments as illustrated in FIG. 1 to FIG. 3.

In addition, in the above embodiments, when the current time-domain signal frame is identified as an effective voice signal, a voice signal originated from a desired signal source is present; and when the current time-domain signal frame is identified as a non-effective voice signal, no voice signal originated from the desired signal source is present.

An embodiment of the present disclosure further provides an electronic device. The electronic device includes the chip for processing voice according to any embodiment of the present disclosure.

In addition, the specific formulas disclosed in the above embodiments are only exemplary ones, causing no limitation. Without departing from the inventive concept of the present disclosure, persons of ordinary skill in the art would make derivatives from these formulas.

The technical solutions according to the embodiments of the present disclosure may be applicable to various types of electronic devices. The electronic device is practiced in various forms, including, but not limited to:

(1) a mobile communication device: which has the mobile communication function and is intended to provide mainly voice and data communications; such terminals include: a smart phone (for example, an iPhone), a multimedia mobile phone, a functional mobile phone, a low-end mobile phone and the like;

(2) an ultra mobile personal computer device: which pertains to the category of personal computers and has the computing and processing functions, and additionally has the mobile Internet access feature; such terminals include: a PDA, a MID, a UMPC device and the like, for example, an iPad;

(3) a portable entertainment device: which displays and plays multimedia content; such devices include: an audio or video player (for example, an iPod), a palm game machine, an electronic book, and a smart toy, and a portable vehicle-mounted navigation device; and (4) another electronic device having the data interaction function.

Theretofore, the specific embodiments of the subject have been described. Other embodiments fall within the scope defined by the appended claims. In some cases, the actions or operations disclosed in the claims may be performed in different sequences, and an expected result is still attainable. In addition, illustrations in the drawings do not necessarily require a specific sequence or a continuous sequence, to attain the expected result. In some embodiments, multi-task processing and parallel processing may be favorable.

Systems, apparatuses, modules, or units illustrated in the above embodiments may be specifically implemented with computer core or entity, or may be implemented with products having specific functions. A typical device for practicing the technical solutions of the present disclosure is a computer. Specifically, the computer may be specifically a personal computer, a laptop computer, a cellular phone, a camera phone, a smart phone, a personal digital assistant, a medium player, a navigation device, an electronic mail receiving and sending device, a game console, a tablet computer, a wearable device or any combination of these devices.

For ease of description, in the description, the apparatuses are divided into various units according to function for separate description. Nevertheless, the function of each unit is implemented in the same or a plurality of software and/hardware when the present disclosure is practiced.

Those skilled in the art shall understand that the embodiments of the present disclosure may be described as illustrating methods, systems, or computer program products. Therefore, hardware embodiments, software embodiments, or hardware-plus-software embodiments may be used to illustrate the present disclosure. In addition, the present disclosure may further employ a computer program product which may be implemented by at least one non-transitory computer-readable storage medium with an executable program code stored thereon. The non-transitory computer-readable storage medium includes but not limited to a disk memory, a CD-ROM, and an optical memory.

The present disclosure is described based on the flowcharts and/or block diagrams of the method, device (system), and computer program product. It should be understood that each process and/or block in the flowcharts and/or block diagrams, and any combination of the processes and/or blocks in the flowcharts and/or block diagrams may be implemented using computer program instructions. These computer program instructions may be issued to a computer, a dedicated computer, an embedded processor, or processors of other programmable data processing device to generate a machine, which enables the computer or the processors of other programmable data processing devices to execute the instructions to implement an apparatus for implementing specific functions in at least one process in the flowcharts and/or at least one block in the block diagrams.

These computer program instructions may also be stored in a computer-readable memory capable of causing a computer or other programmable data processing devices to work in a specific mode, such that the instructions stored on the non-transitory computer-readable memory implement a product including an instruction apparatus. The instruction apparatus implements specific functions in at least one process in the flowcharts and/or at least one block in the block diagrams.

These computer program instructions may also be stored on a computer or other programmable data processing devices, such that the computer or the other programmable data processing devices execute a series of operations or steps to implement processing of the computer. In this way, the instructions, when executed on the computer or the other programmable data processing devices, implement the specific functions in at least one process in the flowcharts and/or at least one block in the block diagrams.

It should be noted that, in this specification, terms "comprises", "comprising" or any other variation thereof, are intended to cover a non-exclusive inclusion, such that a process, method, article, or apparatus, that comprises, has, includes, contains a list of elements does not include only those elements but may include other elements not expressly listed or inherent to such process, method, article, or apparatus. On the premise of no more limitations, an element proceeded by "comprises . . . a" does not, without more constraints, preclude the existence of additional identical elements in the process, method, article, or device.

Those skilled in the art shall understand that the embodiments of the present disclosure may be described as illustrating methods, systems, or computer program products. Therefore, hardware embodiments, software embodiments, or hardware-plus-software embodiments may be used to illustrate the present disclosure. In addition, the present disclosure may further employ a computer program product which may be implemented by at least one non-transitory computer-readable storage medium with an executable program code stored thereon. The non-transitory computer-readable storage medium includes but not limited to a disk memory, a CD-ROM, and an optical memory.

The present disclosure may be described in the general context of the computer-executable instructions executed by the computer, for example, a program module. Generally, the program module includes a routine, program, object, component or data structure for executing specific tasks or implementing specific abstract data types. The present disclosure may also be practiced in the distributed computer environments. In such distributed computer environments, the tasks are executed by a remote device connected via a communication network. In the distributed computer environments, the program module may be located in the native and remote computer storage medium including the storage device.

Detailed above are exemplary embodiments of the present disclosure, and are not intended to limit the present disclosure. For a person skilled in the art, the present disclosure may be subject to various modifications and variations. Any modification, equivalent replacement, or improvement made without departing from the spirit and principle of the present disclosure should fall within the protection scope of the present disclosure.

What is claimed is:

1. A method for detecting voice, comprising:

(a) processing a current time-domain signal frame to obtain sub-band time-domain signals; and (b) determining, according to amplitudes of the sub-band time-domain signals in the current time-domain signal frame, whether the current time-domain signal frame is an effective voice signal;

wherein the (b) determining, according to amplitudes of the sub-band time-domain signals in the current time-domain signal frame, whether the current time-domain signal frame is an effective voice signal comprises:

(b1) calculating signal amplitudes and noise amplitudes of the sub-band time-domain signals in the current time-domain signal frame according to the amplitudes of the sub-band time-domain signals in the current time-domain signal frame; and (b2) determining, according to the noise amplitudes and the signal amplitudes of the sub-band time-domain signals in the current time-domain signal frame, whether the current time-domain signal frame is the effective voice signal; and wherein the (b1) calculating signal amplitudes and noise amplitudes of the sub-band time-domain signals in the current time-domain signal frame according to the amplitudes of the sub-band time-domain signals in the current time-domain signal frame comprises:

(b11) when a signal amplitude of a Nth sub-band time-domain signal in the current time-domain signal frame is greater than a noise amplitude of an Nth sub-band time-domain signal in the previous time-domain signal frame, calculating the noise amplitude of the Nth sub-band time-domain signal in the current time-domain signal frame according to a noise smooth value and the signal amplitude of the Nth sub-band time-domain signal in the current time-domain signal frame, the Nth sub-band time-domain signal being any of the sub-band time-domain signals, N being an integer greater than 0; or (b12) when a signal amplitude of a Nth sub-band time-domain signal in the current time-domain signal frame is less than or equal to a noise amplitude of a Nth sub-band time-domain signal in the previous time-domain signal frame, taking the signal amplitude of the Nth sub-band time-domain signal in the current time-domain signal frame as the noise amplitude of the Nth sub-band time-domain signal in the current time-domain signal frame, the Nth sub-band time-domain signal being any of the sub-band time-domain signals, N being an integer greater than 0.

2. The method according to claim 1, wherein the (b1) calculating signal amplitudes and noise amplitudes of the sub-band time-domain signals in the current time-domain signal frame according to the amplitudes of the sub-band time-domain signals in the current time-domain signal frame comprises: calculating average amplitudes of the sub-band time-domain signals in the current time-domain signal frame according to the sub-band time-domain signals in the current time-domain signal frame; and calculating the signal amplitudes of the sub-band time-domain signals in the current time-domain signal frame according to the average amplitudes of the sub-band time-domain signals in the current time-domain signal frame.

3. The method according to claim 2, wherein the calculating the signal amplitudes and noise amplitudes of the sub-band time-domain signals in the current time-domain signal frame according to the average amplitudes of the sub-band time-domain signals in the current time-domain signal frame comprises: using the average amplitudes of the sub-band time-domain signals in the current time-domain signal frame to characterize the signal amplitudes of the sub-band time-domain signals; or calculating the signal amplitudes of the sub-band time-domain signals in the current time-domain signal frame according to amplitude smooth values and the average amplitudes of the sub-band time-domain signals in the current time-domain signal frame.

4. The method according to claim 1, further comprising: calculating signal-to-noise ratios of the sub-band time-domain signals in the current time-domain signal frame according to the noise amplitudes and the signal amplitudes of the sub-band time-domain signals in the current time-domain signal frame; and the (b2) determining, according to the noise amplitudes and the signal amplitudes of the sub-band time-domain signals in the current time-domain signal frame, whether the current time-domain signal frame is the effective voice signal comprises: determining, according to a total noise amplitude in the current time-domain signal frame and the signal-to-noise ratios of the sub-band time-domain signals in the current time-domain signal frame, whether the current time-domain signal frame is the effective voice signal.

5. The method according to claim 4, wherein the determining, according to the total noise amplitude in the current time-domain signal frame and the signal-to-noise ratios of the sub-band time-domain signals in the current time-domain signal frame, whether the current time-domain signal frame is the effective voice signal comprises:

when the total noise amplitude in the current time-domain signal frame is less than or equal to the noise energy level lower limit, determining whether the signal-to-noise ratios of the sub-band time-domain signals in the current time-domain signal frame are greater than or equal to a signal-to-noise ratio level upper limit, and determining that the current time-domain signal frame is the effective voice signal when the signal-to-noise ratios of the sub-band time-domain signals in the current time-domain signal frame are greater than or equal to the signal-to-noise ratio level upper limit, and determining that the current time-domain signal frame is a non-effective voice signal when the signal-to-noise ratios of the sub-band time-domain signals in the current time-domain signal frame are less than the signal-to-noise ratio level upper limit;

when the total noise amplitude in the current time-domain signal frame is greater than or equal to a noise energy level upper limit, determining whether the signal-to-noise ratios of the sub-band time-domain signals in the current time-domain signal frame are greater than or equal to a signal-to-noise ratio level lower limit, and determining that the current time-domain signal frame is an effective voice signal when the signal-to-noise ratios of the sub-band time-domain signals in the current time-domain signal frame are greater than or equal to the signal-to-noise ratio level lower limit, and determining that the current time-domain signal frame is a non-effective voice signal when the signal-to-noise ratios of the sub-band time-domain signals in the current time-domain signal frame are less than the signal-to-noise ratio level lower limit; or when the total noise amplitude in the current time-domain signal frame is greater than or equal to a noise energy level intermediate threshold, determining whether the signal-to-noise ratios of the sub-band time-domain signals in the current time-domain signal frame are greater than or equal to a corresponding signal-to-noise ratio level intermediate threshold, and determining that the current time-domain signal frame is the effective voice signal when the signal-to-noise ratios of the sub-band time-domain signals in the current time-domain signal frame are greater than or equal to the signal-to-noise ratio level intermediate threshold, and determining that the current time-domain signal frame is a non-effective voice signal when the signal-to-noise ratios of the sub-band time-domain signals in the current time-domain signal frame are less than the signal-to-noise ratio level intermediate threshold.

6. The method according to claim 1, wherein the (b2) determining, according to the noise amplitudes and the signal amplitudes of the sub-band time-domain signals in the current time-domain signal frame, whether the current time-domain signal frame is the effective voice signal comprises:

calculating a total signal amplitude in the current time-domain signal frame according to the signal amplitudes of the sub-band time-domain signals in the current time-domain signal frame; and calculating a total noise amplitude in the current time-domain signal frame according to the noise amplitudes of the sub-band time-domain signals; and determining, according to the total noise amplitude and the total signal amplitude, whether the current time-domain signal frame is the effective voice signal.

7. The method according to claim 6, wherein the determining, according to the total noise amplitude and the total signal amplitude, whether the current time-domain signal frame is the effective voice signal comprises:

when the total noise amplitude and the total signal amplitude are both less than a noise energy level lower limit, determining that the current time-domain signal frame is a non-effective voice signal; or when the total noise amplitude is greater than or equal to a noise energy level upper limit, determining, according to a default configuration item, whether the current time-domain signal frame is the effective voice signal.

8. An apparatus for detecting voice, comprising: a sub-band generation module and a voice activity detection module; wherein the sub-band generation module is configured to process a current time-domain signal frame to obtain sub-band time-domain signals, and the voice activity detection module is configured to determine, according to amplitudes of the sub-band time-domain signals in the current time-domain signal frame, whether the current time-domain signal frame is an effective voice signal;

wherein the apparatus for detecting voice further comprises: an energy calculation module and a noise calculation module; the energy calculation module is configured to calculate signal amplitudes of the sub-band time-domain signals in the current time-domain signal frame according to the amplitudes of the sub-band time-domain signals in the current time-domain signal frame, and the noise calculation module is configured to calculate noise amplitudes of the sub-band time-domain signals in the current time-domain signal frame according to the amplitudes of the sub-band time-domain signals in the current time-domain signal frame, to determine, according to the noise amplitudes and the signal amplitudes of the sub-band time-domain signals in the current time-domain signal frame, whether the current time-domain signal frame is the effective voice signal; and wherein the noise calculation module is further configured to:

when a signal amplitude of a Nth sub-band time-domain signal in the current time-domain signal frame is greater than a noise amplitude of a Nth sub-band time-domain signal in the previous time-domain signal frame, calculate a noise amplitude of the Nth sub-band time-domain signal in the current time-domain signal frame according to a noise smooth value and the signal amplitude of the Nth sub-band time-domain signal in the current time-domain signal frame, the $N^{th}$ sub-band time-domain signal being any of the sub-band time-domain signals, N being an integer greater than 0, or when a signal amplitude of a $N^{th}$ sub-band time-domain signal in the current time-domain signal frame is less than or equal to a noise amplitude of a $N^{th}$ sub-band time-domain signal in the previous time-domain signal frame, directly take the signal amplitude of the $N^{th}$ sub-band time-domain signal in the current time-domain signal frame as a noise amplitude of the $N^{th}$ sub-band time-domain signal in the current time-domain signal frame, the $N^{th}$ sub-band time-domain signal being any of the sub-band time-domain signals, N being an integer greater than 0.

9. The apparatus according to claim 8, wherein the energy calculation module comprises an energy calculation unit; wherein the energy calculation unit is configured to calculate average amplitudes of the sub-band time-domain signals in the current time-domain signal frame according to the sub-band time-domain signals in the current time-domain signal frame, and calculate the signal amplitudes of the sub-band time-domain signals in the current time-domain signal frame according to the average amplitudes of the sub-band time-domain signals in the current time-domain signal frame.

10. The apparatus according to claim 9, wherein the energy calculation unit is further configured to:

use the average amplitudes of the sub-band time-domain signals in the current time-domain signal frame to characterize the signal amplitudes of the sub-band time-domain signals; or calculate the signal amplitudes of the sub-band time-domain signals in the current time-domain signal frame according to amplitude smooth values and the average amplitudes of the sub-band time-domain signals in the current time-domain signal frame.

11. The apparatus according to claim 10, wherein the energy calculation unit is further configured to determine the amplitude smooth values according to an amplitude smooth coefficient and signal amplitudes in a previous time-domain signal frame.

12. The apparatus according to claim 8, wherein the energy calculation module is further configured to calculate a total signal amplitude in the current time-domain signal frame according to the signal amplitudes of the sub-band time-domain signals in the current time-domain signal frame, the noise calculation module is further configured to calculate a total noise amplitude in the current time-domain signal frame according to the noise amplitudes of the sub-band time-domain signals, and the voice activity detection module is further configured to determine, according to the total noise amplitude and the total signal amplitude, whether the current time-domain signal frame is the effective voice signal; or the voice activity detection module is further configured to determine that the current time-domain signal frame is a non-effective voice signal when the total noise amplitude and the total signal amplitude are both less than a noise energy level lower limit; or the voice activity detection module is further configured to determine, according to a default configuration item, whether the current time-domain signal frame is the effective voice signal when the total noise amplitude is greater than or equal to a noise energy level upper limit.

13. The apparatus according to claim 12, further comprising: a signal-to-noise ratio calculation module, configured to calculate signal-to-noise ratios of the sub-band time-domain signals in the current time-domain signal frame according to the noise amplitudes of the sub-band time-domain signals in the current time-domain signal frame; wherein the voice activity detection module is further configured to determine, according to the total noise amplitude in the current time-domain signal frame and the signal-to-noise ratios of the sub-band time-domain signals in the current time-domain signal frame, whether the current time-domain signal frame is the effective voice signal.

14. The apparatus according to claim 13, wherein the voice activity detection module is configured to:

determine whether the signal-to-noise ratios of the sub-band time-domain signals in the current time-domain signal frame are greater than or equal to a signal-to-noise ratio level upper limit when the total noise amplitude in the current time-domain signal frame is less than or equal to a noise energy level lower limit, and determine that the current time-domain signal frame is an effective voice signal when the signal-to-noise ratios of the sub-band time-domain signals in the current time-domain signal frame are greater than or equal to the signal-to-noise ratio level upper limit, and determine that the current time-domain signal frame is a non-effective voice signal when the signal-to-noise ratios of the sub-band time-domain signals in the current time-domain signal frame are less than the signal-to-noise ratio level upper limit;

determine whether the signal-to-noise ratios of the sub-band time-domain signals in the current time-domain signal frame are greater than or equal to a signal-to-noise ratio level lower limit when the total noise amplitude in the current time-domain signal frame is greater than or equal to a noise energy level upper limit, and determine that the current time-domain signal frame is an effective voice signal when the signal-to-noise ratios of the sub-band time-domain signals in the current time-domain signal frame are greater than or equal to the signal-to-noise ratio level lower limit, and determine that the current time-domain signal frame is a non-effective voice signal when the signal-to-noise ratios of the sub-band time-domain signals in the current time-domain signal frame are less than the signal-to-noise ratio level lower limit; or determine whether the signal-to-noise ratios of the sub-band time-domain signals in the current time-domain signal frame are greater than or equal to a corresponding signal-to-noise ratio level intermediate threshold when the total noise amplitude in the current time-domain signal frame is greater than or equal to a noise energy level intermediate threshold; and determine that the current time-domain signal frame is the effective voice signal when the signal-to-noise ratios of the sub-band time-domain signals in the current time-domain signal frame are greater than or equal to the signal-to-noise ratio level intermediate threshold, and determine that the current time-domain signal frame is a non-effective voice signal when the signal-to-noise ratios of the sub-band time-domain signals in the current time-domain signal frame are less than the signal-to-noise ratio level intermediate threshold.

15. A chip for processing voice, comprising: an apparatus for detecting voice and a processor; wherein the apparatus for detecting voice comprises: a sub-band generation module and a voice activity detection module, the sub-band generation module being configured to process a current time-domain signal frame to obtain sub-band time-domain signals, and the voice activity detection module being configured to determine, according to amplitudes of the sub-band time-domain signals in the current time-domain signal frame, whether the current time-domain signal frame is an effective voice signal; and the processor is configured to identify the effective voice signal to perform voice control according to an identification result;

wherein the apparatus for detecting voice further comprises: an energy calculation module and a noise calculation module; wherein the energy calculation module is configured to calculate signal amplitudes of the sub-band time-domain signals in the current time-domain signal frame according to the amplitudes of the sub-band time-domain signals in the current time-domain signal frame, and the noise calculation module is configured to calculate noise amplitudes of the sub-band time-domain signals in the current time-domain signal frame according to the amplitudes of the sub-band time-domain signals in the current time-domain signal frame, to determine, according to the noise amplitudes and the signal amplitudes of the sub-band time-domain signals in the current time-domain signal frame, whether the current time-domain signal frame is the effective voice signal; and wherein the noise calculation module is further configured to:

when a signal amplitude of a Nth sub-band time-domain signal in the current time-domain signal frame is greater than a noise amplitude of a Nth sub-band time-domain signal in the previous time-domain signal frame, calculate a noise amplitude of the Nth sub-band time-domain signal in the current time-domain signal frame according to a noise smooth value and the signal amplitude of the Nth sub-band time-domain signal in the current time-domain signal frame, the $N^{th}$ sub-band time-domain signal being any of the sub-band time-domain signals, N being an integer greater than 0, or when a signal amplitude of an $N^{th}$ sub-band time-domain signal in the current time-domain signal frame is less than or equal to a noise amplitude of a $N^{th}$ sub-band time-domain signal in the previous time-domain signal frame, directly take the signal amplitude of the $N^{th}$ sub-band time-domain signal in the current time-domain signal frame as a noise amplitude of the $N^{th}$ sub-band time-domain signal in the current time-domain signal frame, the $N^{th}$ sub-band time-domain signal being any of the sub-band time-domain signals, N being an integer greater than 0.

* * * * *